US007422038B2

(12) United States Patent
Boler, Jr.

(10) Patent No.: US 7,422,038 B2
(45) Date of Patent: Sep. 9, 2008

(54) LIQUID CHEMICAL DISPENSING SYSTEM WITH SPILL CONTAINMENT DEVICE

(76) Inventor: Lewyn B. Boler, Jr., 1000 E. Channel St., Stockton, CA (US) 95205

( * ) Notice: Subject to any disclaimer, the term of this patent is extended or adjusted under 35 U.S.C. 154(b) by 57 days.

(21) Appl. No.: 11/055,026

(22) Filed: Feb. 9, 2005

(65) Prior Publication Data

US 2006/0174970 A1 Aug. 10, 2006

(51) Int. Cl.
*B65B 1/04* (2006.01)

(52) U.S. Cl. ..... 141/86; 141/103; 141/237; 141/247; 137/313; 222/108

(58) Field of Classification Search ..... 141/2, 141/9, 18, 86, 100, 103, 234, 237, 247, 363–366; 137/312–314; 222/108; 422/99
See application file for complete search history.

(56) References Cited

U.S. PATENT DOCUMENTS

| | | | | | |
|---|---|---|---|---|---|
| 4,875,595 | A | | 10/1989 | Van Valkenburg | |
| 5,052,569 | A | | 10/1991 | Cooper | |
| 5,063,977 | A | * | 11/1991 | Belland | 141/86 |
| 5,099,873 | A | | 3/1992 | Sanchez | |
| 5,259,557 | A | * | 11/1993 | Spriggs et al. | 239/304 |
| 5,356,206 | A | | 10/1994 | Van Valkenburgh | |
| 5,381,839 | A | * | 1/1995 | Dowd | 141/242 |
| 5,542,572 | A | * | 8/1996 | Davis | 222/108 |
| 6,059,145 | A | * | 5/2000 | Stratton et al. | 222/78 |
| 6,119,736 | A | * | 9/2000 | Huang et al. | 141/88 |
| 6,439,272 | B1 | * | 8/2002 | Wertheim | 141/2 |
| 6,679,400 | B1 | * | 1/2004 | Goodman | 222/108 |

OTHER PUBLICATIONS

Lab Safety Supply, "Poly-Rack System" (2 pages); www.labsafety.com; date is Mar. 22, 2006, but products are representative of products that may have predated applicant's invention date; published via internet.

Lab Safety Supply, "Lab Safety Supply SteelSkids Platforms" (2 pages); www.labsafety.com; date is Mar. 22, 2006, but products are representative of products that may have predated applicant's invention date; published via internet.

(Continued)

*Primary Examiner*—Timothy L Maust
(74) *Attorney, Agent, or Firm*—Schnader Harrison Segal & Lewis LLP

(57) ABSTRACT

A system for handling chemicals includes a base; a supply container handling area disposed on the base and configured to hold at least one supply container; a drainage vessel disposed on the base and located with respect to the supply container handing area so as to catch liquids spilled or leaking in the supply container handling area; and an overflow vessel receiving area disposed upon the base and configured to hold at least one overflow vessel. The drainage vessel has an outlet and is configured to allow a liquid spilled or leaking into the drainage vessel to flow out of the drainage vessel through the outlet and into an overflow vessel in fluid communication with the outlet of the drainage vessel. The system may also include a supply container, a trigger-pumped spray bottle, an information display board, and a compliance-status indicator. The system may include multiple supply vessels, drainage vessels, and overflow vessels.

20 Claims, 3 Drawing Sheets

OTHER PUBLICATIONS

Lab Safety Supply, "Econo-Dike" (1 page); www.labsafety.com; date is Mar. 22, 2006, but products are representative of products that may have predated applicant's invention date; published via internet.

Lab Safety Supply, "Steel Spill Containment Pallets" (2 pages); www.labsafety.com; date is Mar. 22, 2006, but products are representative of products that may have predated applicant's invention date; published via internet.

Lab Safety Supply, "Steel Spill Containment Sumps" (1 page); www.labsafety.com; date is Mar. 22, 2006, but products are representative of products that may have predated applicant's invention date; published via internet.

Lab Safety Supply, "Ultra-HardTop P2 and P4 Plus Containment System" (1 page); www.labsafety.com; date is Mar. 22, 2006, but products are representative of products that may have predated applicant's invention date; published via internet.

Lab Safety Supply, "Ultra-SpillDecks Build-Your-Own Containment Systems" (2 pages); www.labsafety.com; date is Mar. 22, 2006, but products are representative of products that may have predated applicant's invention date; published via internet.

Safeway Products, list of products (1 page); www.safewayproductsinc.com; date is Mar. 22, 2006, but products are representative of products that may have predated applicant's invention date; published via internet.

Safeway Products, "IBC Spill Control" (1 page); www.safewayproductsinc.com; date is Mar. 22, 2006, but products are representative of products that may have predated applicant's invention date; published via internet.

Safeway Products, Photographs of IBC Spill Control (1 page); www.safewayproductsinc.com; date is Mar. 22, 2006, but products are representative of products that may have predated applicant's invention date; published via internet.

Environmental Compliance Products, "Hazardous Material Storage Buildings" (1 page); www.epcenvironmental.com; date is Mar. 22, 2006, but products are representative of products that may have predated applicant's invention date; published via internet.

Environmental Compliance Products, "Portable Hazardous Materials Storage Structures: The System" (2 pages); www.epcenvironmental.com; date is Mar. 22, 2006, but products are representative of products that may have predated applicant's invention date; published via internet.

Environmental Compliance Products, "Portable Hazardous Materials Storage Structures: Models" (3 pages); www.epcenvironmental.com; date is Mar. 22, 2006, but products are representative of products that may have predated applicant's invention date; published via internet.

Environmental Compliance Products, "Portable Hazardous Materials Storage Structures: Features and Options" (3 pages); www.epcenvironmental.com; date is Mar. 22, 2006, but products are representative of products that may have predated applicant's invention date; published via internet.

Environmental Compliance Products, "Portable Hazardous Materials Storage Structures: Dimensions" (1 page); www.epcenvironmental.com; date is Mar. 22, 2006, but products are representative of products that may have predated applicant's invention date; published via internet.

Environmental Compliance Products, "Portable Hazardous Materials Storage Structures: Photos" (2 pages); www.epcenvironmental.com; date is Mar. 22, 2006, but products are representative of products that may have predated applicant's invention date; published via internet.

Lab Safety Supply, "Poly-Rack System" (1 page); www.labsafety.com; date is Mar. 22, 2006, but products are representative of products that may have predated applicant's invention date; published via internet.

Lab Safety Supply, "Eagle Mobile Spill Control Platform" (1 page); www.labsafety.com; date is Mar. 22, 2006, but products are representative of products that may have predated applicant's invention date; published via internet.

* cited by examiner 100
80
20
22
90
32
30
38
34
52
50
40
70
15
18
12
110
10
16
14

112
116
110

LIQUID CHEMICAL DISPENSING SYSTEM WITH SPILL CONTAINMENT DEVICE

BACKGROUND OF THE INVENTION (1) Field of the Invention

This invention relates to the field of handling chemicals, including potentially hazardous chemicals. This invention is particularly useful in the field of the cleaning and maintenance of vehicles, industrial equipment, and other items, in which chemicals are used to clean and preserve equipment or vehicle surfaces.

(2) Description of the Related Art

Chemicals often are supplied in large (for example, five-gallon) containers and then transferred into smaller (for example, one-quart) spray bottles for convenient use. For example, in the field of commercial and industrial cleaning and maintenance, and in the field of vehicle detailing, workers apply chemicals to various components and surfaces of a piece of equipment such as a vehicle in order to protect components and surfaces and to enhance appearance. These fields often involve the use of various chemicals, such as degreasers, cleaners, and dressings. Often these chemicals are applied to surfaces of a vehicle or other object using common spray bottles. When the chemicals are supplied in large containers and then transferred into smaller containers for use, there is a need for convenient system for storing the large containers and the spray bottles of the chemicals and for conveniently transporting them around the work area.

In addition, when workers must transfer chemicals from larger containers to spray containers, spills occur. The spills can cause problems common to spilled liquids generally (slippery floors) and also cause problems caused by particular chemicals being used. For example, glass cleaners may be inflammable; degreasers may pose health hazards. Many chemicals used in cleaning and maintenance operations are subject to regulations requiring spill containment. As a result, there is a need for a convenient system for containing spills that occur when the chemicals are transferred from larger containers to the spray bottles or when containers leak.

Environmental and safety concerns have led to government regulation of the manner in which many chemicals are handled and stored. Regulations may require, among other measures, that a user provide spill containment when using some regulated substances. Regulations may also require government approval of chemicals that are used for certain purposes, including, for example, chemicals used in cleaning and treating vehicles and other equipment.

Various spill-containment systems are known, including dikes surrounding tanks and platforms having grates with reservoirs below. The inventor is not aware of any other spill containment system that is adapted for use in a setting where the chemicals are used in spray bottles or in other relatively small (about one quart or less) quantities. In addition, the inventor is not aware of any systems providing the economic and environmental benefits of immediate recycling of spilled chemicals in a setting where the chemicals are used in spray bottles or other relatively small quantities.

BRIEF SUMMARY OF THE INVENTION

It is an object of this invention to provide a system allowing for the convenient storage and handling of chemicals in a manner compatible with one or more regulatory requirements. It is another object of this invention to provide a system allowing for the convenient handling of chemicals while also providing for containment of spills. It is another object of certain embodiments of this invention to provide a system allowing for the convenient handling of chemicals while also allowing for recycling of spilled chemicals.

To achieve these and other advantages and objects, and in accordance with the purposes of the invention as embodied and broadly described herein, in one aspect the inventor describes a first embodiment of a system according to the invention. The first embodiment includes a base; a supply container handling area disposed on the base and configured to hold at least one supply container; and a drainage vessel disposed on the base and located with respect to the supply container handing area so as to catch liquids spilled or leaking in the supply container handling area. The drainage vessel has an outlet, and the drainage vessel is configured to allow a liquid spilled into the drainage vessel to flow out of the drainage vessel through the outlet. The first embodiment also includes an overflow vessel in fluid communication with the outlet of the drainage vessel.

The base is of sufficient size and strength to support the items disposed thereon and the supply containers and overflow vessels used with the base. A sturdy steel or plastic frame may be suitable. The base may optionally have wheels, casters, or the like to allow the base to be moved about. The base also may have additional storage shelves, platforms, or areas.

The supply container handling area may be disposed upon the base either through mechanical attachment or by being formed as an integral part of the base. The supply container handling area is a platform configured to hold one or more supply containers; preferably it is disposed at a convenient height for manipulating at least one supply container. The supply container handling area typically may be disposed near the top of the base and in any event is disposed at or above the level at which the drainage vessel is disposed. The supply container handling area preferably has a raised edge or border adapted so that any liquid spilled or leaking in the supply container handling area will be directed to the drainage vessel. In embodiments designed to handle more than one type of chemical, the supply container handling area preferably is subdivided so that a leak of one chemical will be directed to its corresponding drainage vessel. To be clear, the terms "spill" and "spilled," as used throughout this patent, refer to spills caused by handling as well as spills caused by leaking containers.

The drainage vessel is disposed on the base and located at or below the level of the supply container handing area so as to catch liquids spilled or leaking from a container in the supply container handling area. The drainage vessel has an outlet and is configured to allow a liquid spilled into the drainage vessel to flow out of the drainage vessel through the outlet. The drainage vessel may take any shape but is preferably a shallow tray or box. The drainage vessel may optionally be contoured to allow liquids to flow downward to the outlet by placing the outlet in an area that sits at a lower elevation than the remainder of the drainage vessel. In embodiments adapted to handle more than one chemical mixture at a time, a drainage—vessel each with its own outlet in communication with an overflow vessel—may preferably be provided for each chemical mixture. A plurality of drainage vessels may be created by subdividing a tray or other structure so that liquid flowing into one tray subdivision will not flow into another subdivision.

The overflow vessel is placed at a location below the drainage vessel and is in fluid communication with the outlet of the drainage vessel, typically through tubing or piping connected to the outlet of the drainage vessel and an inlet found on a surface of the drainage vessel. A plurality of overflow vessels likewise may be provided so that preferably each chemical mixture has its own supply container handling area, drainage vessel, outlet, and overflow vessel. Preferably each overflow vessel has a volume at least 25 percent greater than the volume of the largest supply container that will be handled above the drainage vessel associated with the particular overflow vessel. For example, a four-gallon supply container would preferably be used with a five-gallon overflow vessel.

Although an overflow vessel receiving area is not necessary to the invention, the system is rendered more convenient if there is an overflow vessel receiving area, configured to hold at least one overflow vessel and disposed upon the base, to accommodate placement of the overflow vessel both at the proper height and in fluid communication with the drainage vessel outlet. Preferably the overflow vessel receiving area has a side wall of sufficient height to allow containment, with the overflow vessel receiving area stocked with a full complement of whatever overflow vessels are intended to be placed therein, of 125 percent of the volume of the largest container to be used with the system. Thus, for example, if the system includes a five-gallon overflow vessel as its largest vessel and is intended for use with four different chemicals, the overflow vessel receiving area would preferably have a side wall height sufficient to allow containment of 6.25 gallons of liquid, even with four of the five-gallon overflow containers present in the overflow vessel receiving area.

In one embodiment, the user may provide the supply container containing chemicals to be handled using the system. Optionally, the system may include a supply container, which may be any container and which may optionally be a five-gallon container having a screw-type outlet valve or optionally a valve-controlled outlet with a spring-loaded, self-closing outlet valve. Examples of suitable spring-loaded valves are the No-Drip® line sold by Tomlinson Industries. Optionally the system may include chemicals certified to meet regulations applicable to a particular use of the system.

In one embodiment, the user may provide a trigger-pumped spray bottle for each chemical to be handled using the system. Optionally, the system may be supplied with a trigger-pumped spray bottle for each chemical to be handled using the system. Examples of trigger pumps, which are common items, include those sold by Production Car Care (see productioncarcare.com).

The system may optionally include a rail disposed upon the base and configured such that a trigger-pumped spray bottle may be hung over the rail. The rail may be conveniently be formed or attached along a side wall of a drainage vessel.

The base optionally may include a perimeter wall disposed upon the base and having an opening therein and a cover attachable to the base to block the opening. In one embodiment, the perimeter wall is a mesh affixed to the base and covering the external planes of the base except for one portion thereof; the cover is one or more doors that are hinged and are fastenable and lockable to block the opening and secure the contents of the base.

The system optionally may include an information display board disposed upon the base in a visually prominent position. The display board may optionally be a flat plate of appropriate size to accommodate any other information to be communicated to users of the device and the chemicals therein. The display board optionally could take the form of a television or other electronic display.

The system also optionally may include a compliance-status indicator that may be used to indicate whether the system is currently compliant with any regulatory or other requirements of interest. In one embodiment, the compliance-status indicator is a magnetic strip that states that the device is compliant with a particular regulation; the magnetic strip may be removed if the device becomes non-compliant or is found to be non-compliant upon inspection.

Embodiments of the invention may include one or more of the following: fluid piping connecting the drainage area to the inlet of an overflow container; and a display board to allow for the attachment of warnings, instructions, or other information in close proximity to the contents of the device.

In systems designed for handling more than one chemical mixture at a time, the system optionally includes color coded spray bottles, supply containers, overflow vessels, display boards, and optionally information sheets such as Material Safety Data Sheets, with the various components related to a particular chemical sharing a common coloration (or having a commonly colored label or mark) to allow the user to easily associate the various components and information relating to the chemical being handled by those components.

The device optionally may include a secondary storage shelf. The secondary storage shelf preferably may take the form of a shelf suitable for storing additional containers of chemicals and having sidewalls that enable the shelf to hold a liquid that leaks or is spilled thereon; preferably such sidewalls have a height sufficient to allow the secondary storage shelf to contain a spill or leak of 125 percent of the capacity of the largest vessel to be stored on the shelf, when such volume is measured with the secondary storage shelf fully filled with chemical storage containers. Preferably the sidewalls may meet or exceed a height prescribed by applicable regulations. The secondary storage shelf optionally is equipped with an outlet controllable by a valve. Thus liquid spilled or leaking into the secondary storage vessel may be held briefly at that location and then released through the outlet and the valve into an appropriate container.

Optionally, the base may be equipped with an overflow vessel receiving area, which may take the form of a shelf suitable for storing overflow vessels and having sidewalls that enable the shelf to hold a liquid that leaks or is spilled thereon; preferably such sidewalls have a height sufficient to allow the secondary storage shelf to contain a spill of 125 percent of the capacity of the largest vessel to be stored on the shelf, when such volume is measured with the storage shelf holding a full complement of chemical storage containers. Preferably the sidewalls may meet or exceed a height prescribed by applicable regulations. The overflow vessel receiving area optionally is equipped with an outlet controllable by a valve so that a spilled or leaked liquid may be held briefly at that location and then released into an appropriate container.

Both the foregoing general description and the following detailed description are exemplary and explanatory only and do not restrict the invention as claimed.

DETAILED DESCRIPTION OF THE INVENTION

Figure 1:
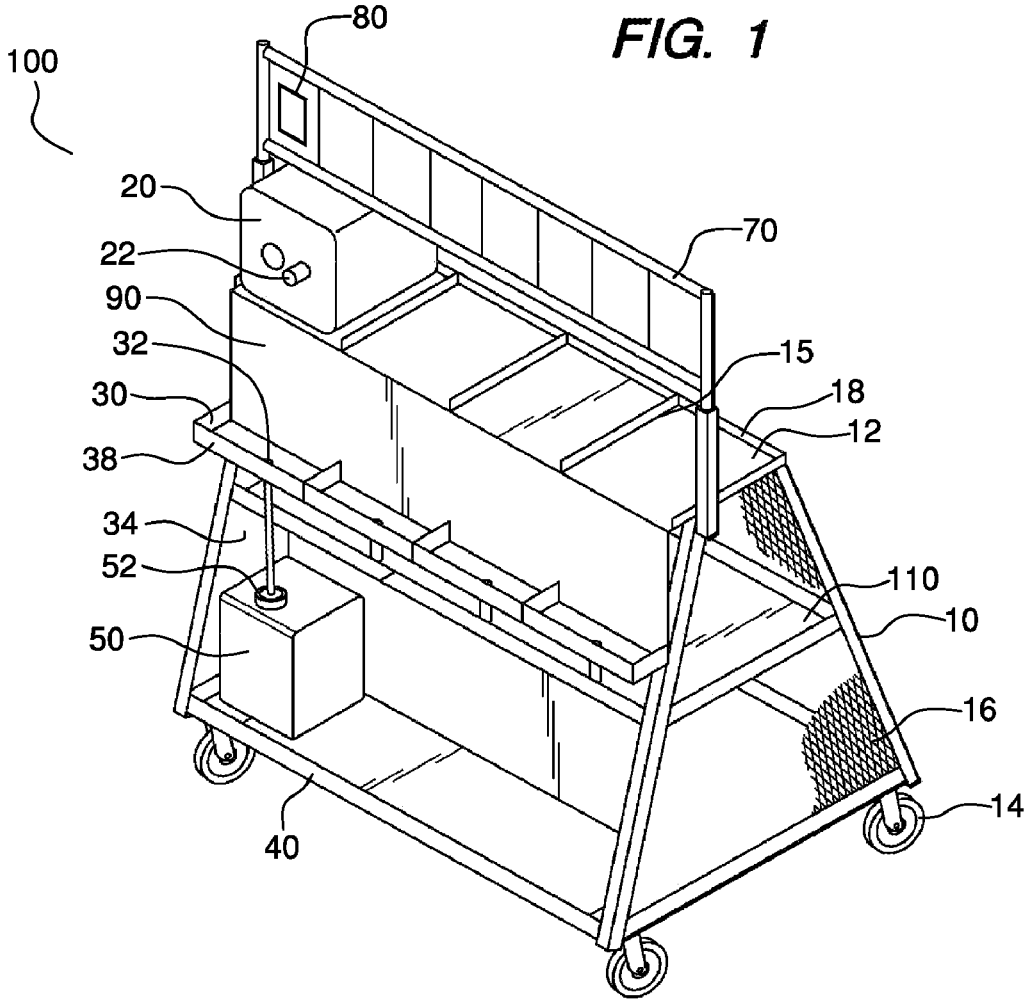
FIG. 1 is a front perspective view of a system according to the invention.
Figure 2:
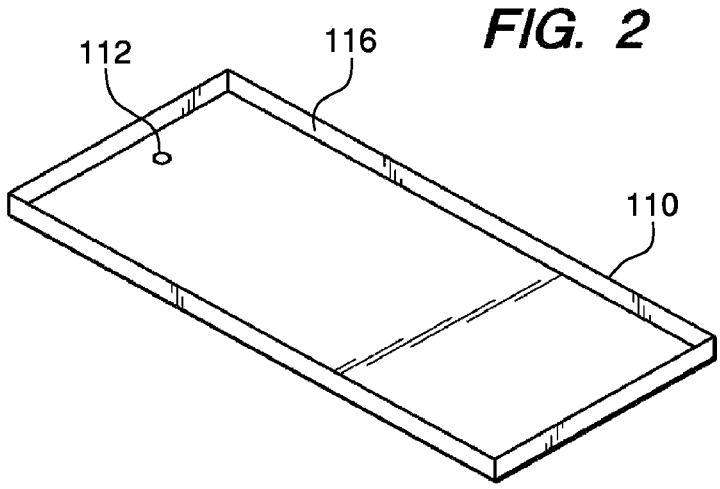
FIG. 2 is a top perspective view of a secondary storage shelf according to the invention.
Figure 3:
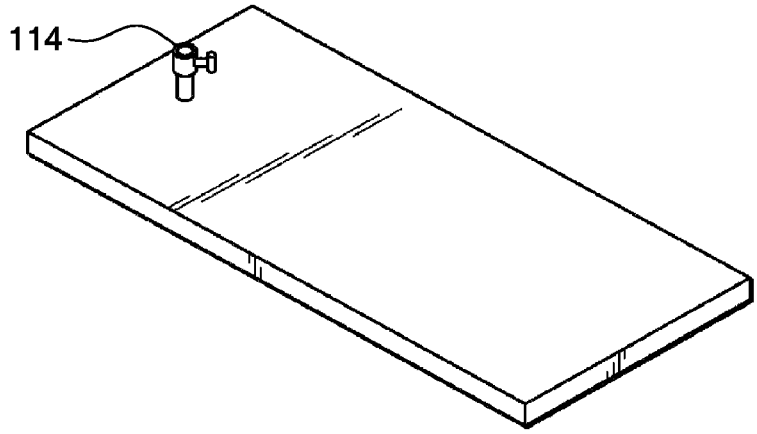
FIG. 3 is a bottom perspective view of a secondary storage shelf according to the invention.
Figure 4:
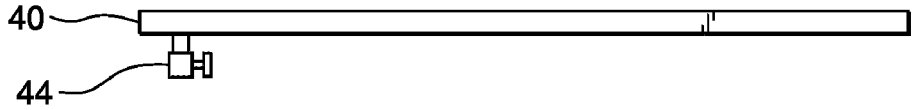
FIG. 4 is a front side view of an overflow vessel storage area according to the invention.
Figure 5:
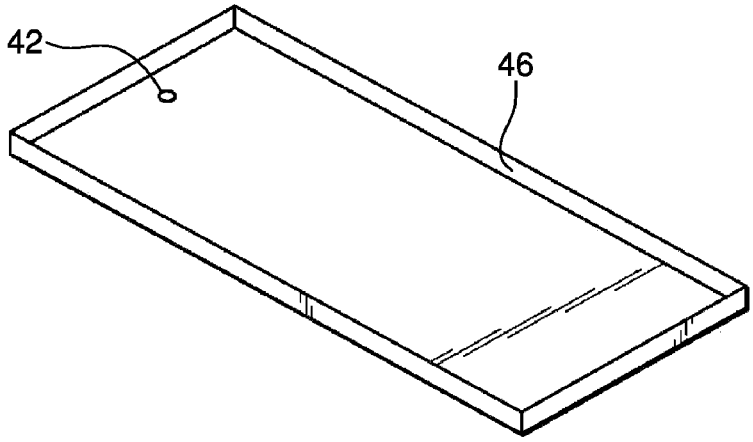
FIG. 5 is a top perspective view of an overflow vessel storage area according to the invention.
Figure 6:
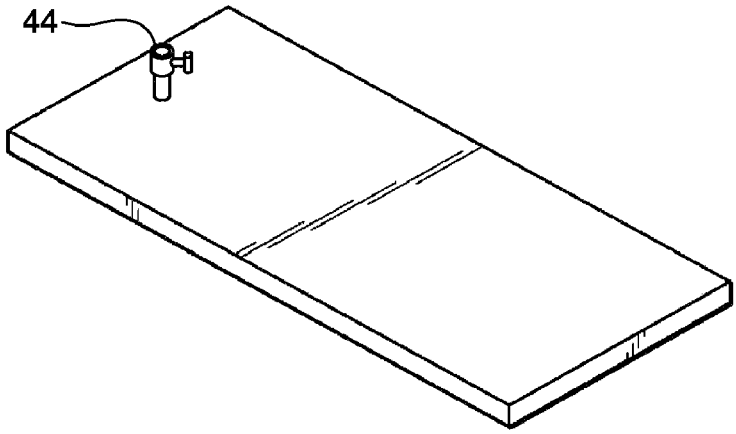
FIG. 6 is a bottom perspective view of an overflow vessel storage area according to the invention.

An embodiment of a system 100 according to the invention includes base 10; supply container handling area 12 disposed on base 10 and formed as an integral portion thereof and configured to hold four supply containers 20; four drainage vessels 30 disposed on the base 10 and located with respect to the supply container handing area 12 so as to catch liquids spilled in the supply container handling area 12; and an overflow vessel receiving area 40 disposed upon the base and configured to hold at least one overflow vessel 50. Each drainage vessel 30 has an outlet 32 and is configured to allow a liquid spilled or leaking into the drainage vessel to flow out of the drainage vessel 30 through the outlet 32 and into an overflow vessel 50 in fluid communication with the outlet of the drainage vessel 30. Rail 38 is formed as part of the front side wall of the drainage vessel 32 by selecting a height that allows a trigger-pumped spray bottle to be hung thereon by placing the trigger over rail 38 and lowering the trigger-pumped spray bottle. The embodiment shown may accommodate four supply containers 20 in the supply container handling area 12, at least four trigger-pumped spray bottles, an information display board 70, and a compliance-status indicator 80 in the form of an adhesive decal indicating compliance with regulations.

Figure 7:
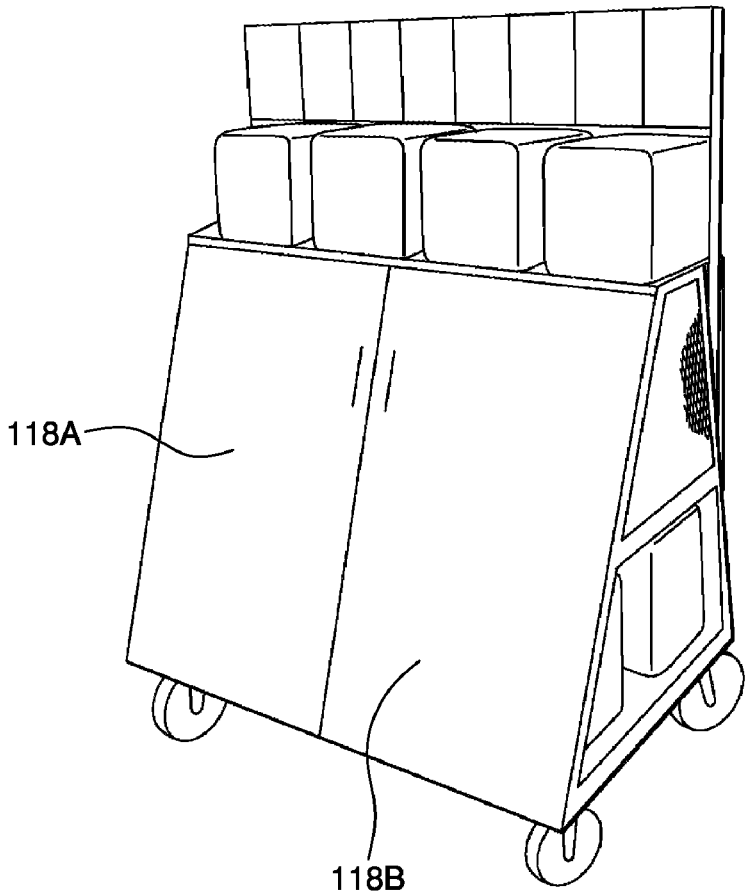
FIG. 7 is a rear perspective view of a system according to the invention.

Base 10 has casters 14, perimeter walls 16 (mesh shown in broken view in FIG. 1), and metal doors 118A and 118B, which may be seen in FIG. 7. Supply container handling area 12 has side wall 18 and dividers 15, which channel a leak or spill of a particular chemical to the corresponding drainage vessel 30 by way of front plate 90. Front plate 90 provides a means for liquids spilled in supply vessel handling area 12 to flow a drainage vessel 30.

I claim:

1. A system, comprising:

a base;

a supply container handling area disposed on the base and configured to hold at least one supply container;

a drainage vessel disposed on the base and located with respect to the supply container handling area so as to catch liquids spilled or leaking in the supply container handling area, the drainage vessel having an outlet, and the drainage vessel being configured to allow a liquid to flow out of the drainage vessel through the outlet;

an overflow vessel receiving area disposed upon the base and configured to hold at least one overflow vessel, wherein the overflow vessel receiving area is adapted for containing a liquid spilled therein;

an outlet and an outlet control valve disposed upon the overflow vessel receiving area so as to permit the release of a liquid from the overflow vessel receiving area;

wherein the supply container handling area is configured to hold more than one supply container;

the system comprises more than one supply container;

the base is equipped with a number of drainage vessels equal to the number of supply containers that may be held in the supply container receiving area;

the base is equipped with a separate overflow vessel in fluid communication with the outlet of each drainage vessel.

2. A system according to claim 1, wherein each overflow vessel has a volume at least 25 percent greater than the volume of the largest supply container that will be handled above the drainage vessel that is in fluid communication with the particular overflow vessel.

3. A system according to claim 1, wherein the supply container has a self-closing valve for releasing the contents of the supply container.

4. A system according to claim 1, further comprising:

a liquid transfer plate, said liquid transfer plate being a generally planar body configured to allow a liquid spilled or leaking in the supply container handling area to flow on said liquid transfer plate to a drainage vessel disposed below the supply container handling area.

5. A system according to claim 1, further comprising a secondary storage shelf having a side wall, the side wall disposed around the perimeter of the secondary storage shelf and having a height sufficient to allow the secondary storage shelf to contain, with the shelf fully occupied with storage containers intended for use on the secondary storage shelf, at least 125 percent of the volume of the largest container intended for storage on the secondary storage shelf.

6. A system according to claim 1, wherein each supply container contains a chemical mixture meeting all applicable regulations affecting the activity for which the system is planned to be used.

7. A system according to claim 1, further comprising a trigger-pumped spray bottle corresponding to each supply container.

8. A system according to claim 1, further comprising an information display board.

9. A system according to claim 1, further comprising a compliance-status indicator.

10. A system according to claim 1, further comprising a rail disposed upon the base and configured such that a trigger-pumped spray bottle may be hung over the rail.

11. A system according to claim 1, wherein each corresponding supply container, drainage vessel, and overflow vessel are color-coded.

12. A system according to claim 11, further comprising a color-coded trigger-pumped spray bottle corresponding to each set supply container, drainage vessel, and overflow vessel.

13. A system according to claim 11, further comprising an information-display board and a compliance-status indicator.

14. A system according to claim 12, further comprising an information-display board and a compliance-status indicator.

15. A system according to claim 11, further comprising a liquid transfer plate, said liquid transfer plate being a generally planar body configured to allow a liquid spilled or leaking in the supply container handling area to flow on said liquid transfer plate to a drainage vessel disposed below the supply container handling area.

16. A system according to claim 12, further comprising a liquid transfer plate, said liquid transfer plate being a generally planar body configured to allow a liquid spilled or leaking in the supply container handling area to flow on said liquid transfer plate to a drainage vessel disposed below the supply container handling area.

17. A system according to claim 13, further comprising a liquid transfer plate, said liquid transfer plate being a generally planar body configured to allow a liquid spilled or leaking in the supply container handling area to flow on said liquid transfer plate to a drainage vessel disposed below the supply container handling area.

18. A system according to claim 14, further comprising a liquid transfer plate, said liquid transfer plate being a generally planar body configured to allow a liquid spilled or leaking in the supply container handling area to flow on said liquid transfer plate to a drainage vessel disposed below the supply container handling area.

19. A system, comprising:

a base:

a supply container handling area disposed on the base and configured to hold at least one supply container;

a drainage vessel disposed on the base and located with respect to the supply container handling area so as to catch liquids spilled or leaking in the supply container handling area, the drainage vessel having an outlet, and the drainage vessel being configured to allow a liquid to flow out of the drainage vessel through the outlet;

an overflow vessel receiving area disposed upon the base and configured to hold at least one overflow vessel, wherein the overflow vessel receiving area is adapted for containing a liquid spilled therein;

an outlet and an outlet control valve disposed upon the overflow vessel receiving area so as to permit the release of a liquid from the overflow vessel receiving area; and wherein:

the supply container handling area is configured to hold more than one supply container;

the system comprises more than one supply container;

the base is equipped with a plurality of drainage vessels;

the base is equipped with a separate overflow vessel in fluid communication with the outlet of each drainage vessel.

20. A system according to claim 19, further comprising a liquid transfer plate, said liquid transfer plate being a generally planar body configured to allow a liquid spilled or leaking in the supply container handling area to flow on said liquid transfer plate to a drainage vessel disposed below the supply container handling area.

* * * * *